US007686098B2

(12) United States Patent
Tyer

(10) Patent No.: US 7,686,098 B2
(45) Date of Patent: Mar. 30, 2010

(54) CHAIN DRIVEN RECIPROCATING HAMMER WITH WORK PIECE CENTERING AND CLAMPING

(75) Inventor: Robert Clark Tyer, Jacksonville, FL (US)

(73) Assignee: Pileco Inc., Houston, TX (US)

( * ) Notice: Subject to any disclaimer, the term of this patent is extended or adjusted under 35 U.S.C. 154(b) by 0 days.

(21) Appl. No.: 12/367,262

(22) Filed: Feb. 6, 2009

(65) Prior Publication Data

US 2009/0139737 A1 Jun. 4, 2009

Related U.S. Application Data

(62) Division of application No. 11/823,132, filed on Jun. 27, 2007, now abandoned.

(51) Int. Cl.
*B25D 1/00* (2006.01)

(52) U.S. Cl. ..... 173/53; 173/184; 173/90; 173/92; 173/88

(58) Field of Classification Search ..... 173/53, 173/28, 184, 90, 92
See application file for complete search history.

(56) References Cited

U.S. PATENT DOCUMENTS

| | | | | | |
|---|---|---|---|---|---|
| 2,476,390 | A * | 7/1949 | Simmonds | 173/190 |
| 3,700,047 | A | 10/1972 | Gartner | |
| 3,833,072 | A * | 9/1974 | Back | 175/85 |
| 3,934,655 | A | 1/1976 | Whistle | |
| 4,050,526 | A | 9/1977 | Deike | |
| 4,075,858 | A * | 2/1978 | Frederick | 405/228 |
| 4,124,081 | A | 11/1978 | Deike | |
| 4,280,772 | A * | 7/1981 | Rusche | 405/232 |
| 4,303,130 | A * | 12/1981 | Bonca | 173/189 |
| 4,315,550 | A | 2/1982 | Fulkerson et al. | |
| 4,371,041 | A | 2/1983 | Becker et al. | |
| 4,439,056 | A | 3/1984 | Reilly et al. | |
| 4,601,352 | A | 7/1986 | Hamilton | |
| 4,993,500 | A | 2/1991 | Greene et al. | |
| 5,012,873 | A | 5/1991 | Kennedy et al. | |
| 5,040,927 | A * | 8/1991 | Wickberg | 405/232 |
| 5,095,600 | A * | 3/1992 | Allan | 29/81.16 |
| 5,174,386 | A * | 12/1992 | Crover | 173/53 |
| 5,332,047 | A | 7/1994 | Hignite | |
| 5,494,117 | A | 2/1996 | Aldridge | |
| 6,199,641 | B1 * | 3/2001 | Downie et al. | 173/55 |
| 6,305,480 | B1 | 10/2001 | Franklin | |
| 6,378,624 | B1 * | 4/2002 | Liu | 173/216 |
| 6,598,683 | B1 | 7/2003 | Ultimo et al. | |
| 6,702,037 | B1 | 3/2004 | Thiessen | |
| 7,063,172 | B1 * | 6/2006 | Marentette | 173/184 |
| 7,296,636 | B1 | 11/2007 | Vreeland | |
| 7,314,098 | B2 * | 1/2008 | Miller | 173/49 |
| 7,331,405 | B2 | 2/2008 | Robson | |
| 2005/0189128 | A1 | 9/2005 | Vought | |
| 2005/0199405 | A1 * | 9/2005 | Raunisto | 173/53 |
| 2006/0042811 | A1 * | 3/2006 | Hagemeyer | 173/1 |
| 2008/0000661 | A1 * | 1/2008 | Miller | 173/49 |

* cited by examiner

*Primary Examiner*—Brian D Nash
(74) *Attorney, Agent, or Firm*—Fletcher Yoder PC

(57) ABSTRACT

In accordance with the present invention, a chain driven reciprocating hammer is disclosed. The chain driven reciprocating hammer includes a chain system for lifting a ram to a drop point. The chain system includes a plurality of sprockets and a chain with at least one mesh link to mesh with the ram. Additionally, the chain driven reciprocating hammer includes an adjustable tandem release sprocket mechanism. Also, the chain driven reciprocating hammer includes a center and clamping mechanism configured to secure a work input.

8 Claims, 4 Drawing Sheets

A, B, C

CHAIN DRIVEN RECIPROCATING HAMMER WITH WORK PIECE CENTERING AND CLAMPING

CROSS REFERENCE TO RELATED APPLICATION

This is a divisional of application Ser. No. 11/823,132 filed on Jun. 27, 2007, now abandoned, which is hereby incorporated by reference in its entirety.

FIELD OF THE INVENTION

The present invention relates generally to reciprocating hammers and, more particularly, to chain driven reciprocating hammers with work piece centering and clamping mechanisms.

BACKGROUND OF THE INVENTION

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Free fall or drop type hammers have been used and are still being used for driving pile, poles, pipe etc., which are referred to herein as work input (or work piece). Hammer rams have historically been lifted to a free fall height (drop height) by manual labor, winch and cable systems, compressed air, hydraulic fluid under pressure and the explosive force of diesel fuel combustion. The pull of gravity in relation to the mass of the ram releases a driving force upon impact with the work input that is being driven. The above mentioned methods of raising a ram are energy intensive and require a heavy supporting structure.

Additionally, conventional driving systems require ancillary work input positioning systems, such as leads, pull ropes, etc. to accurately position and hold the driving hammer and work input in a linear configuration perpendicular to a substrate such as the ground, beach, etc. that the driven work input is being driven into. Moreover, pile driving hammers with conventional bells, bonnets, etc. cannot adjust their internal inlet diameter to conform with the various outside diameters found with work input such as wooden piles or poles, for example. Although wooden pile or poles may generally have a consistent overall length, their outside diameters at the driven end can, and most often do, vary with each individual pile or pole.

Embodiments of the present invention may address one or more of the issues mentioned above.

BRIEF DESCRIPTION OF THE DRAWINGS

Advantages of the invention may become apparent upon reading the following detailed description and upon reference to the drawings in which.

DETAILED DESCRIPTION OF SPECIFIC EMBODIMENTS

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In accordance with the present techniques, a reciprocating hammer that exhibits superior production performance and securely mechanically grasps and positions work inputs, thus reducing the need for hand-held lines for hand positioning by workmen. The reciprocating hammer allows for measurable adjustment as to hammering force per blow and the number of blows per minute. Additionally, it provides accurate and repeatable low bearing measurements for each work input driven or hammered and has very positive capital/operating costs over a broad range of hammering or driving applications. Moreover, the reciprocating hammer is relatively environmentally friendly when compared with conventional hammers due to the greatly reduced energy demands. Although the various embodiments described herein are described with reference to a pile driving application, it should be understood by one of ordinarily skilled in the art, that this is but one of many applications for this device.

Figure 1:
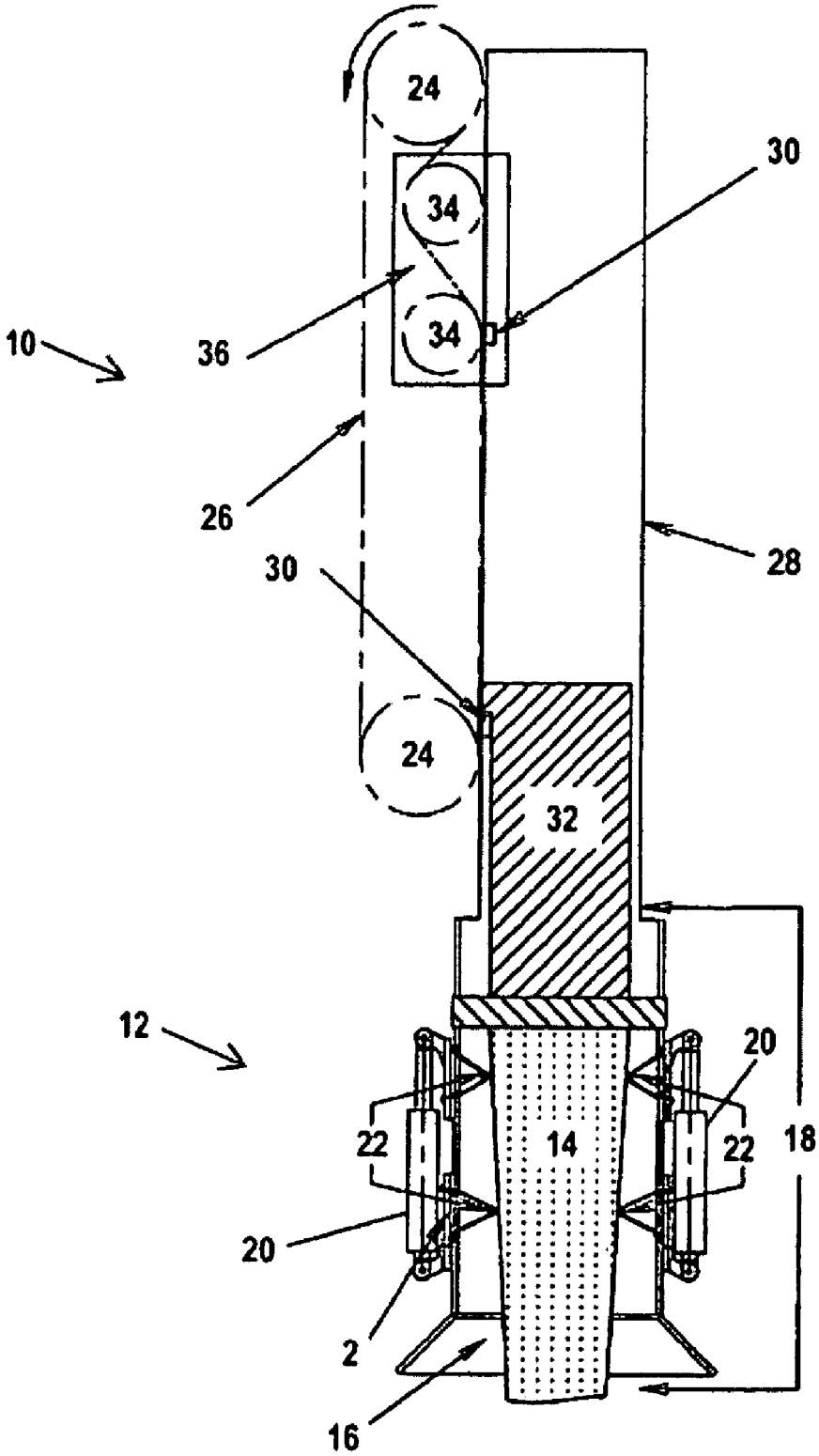
FIG. 1 illustrates a chain driven reciprocating hammer with automatic centering and clamping in accordance with an exemplary embodiment of the present invention.

Turning now to the figures and referring initially to FIG. 1, a chain driven hammer is illustrated and generally referred to by the reference numeral 10. The chain driven hammer 10 is used in combination with an automatic work piece centering and clamping mechanism 12. As shown, a work input 14 (i.e., pile, pole, pipe, etc.) is positioned within the throat 16 of the automatic work piece centering and clamping mechanism 12. The automatic work piece centering and clamping mechanism 12 forms part of a bell (bonnet) 18 of the chain driven hammer 10.

Figure 3:
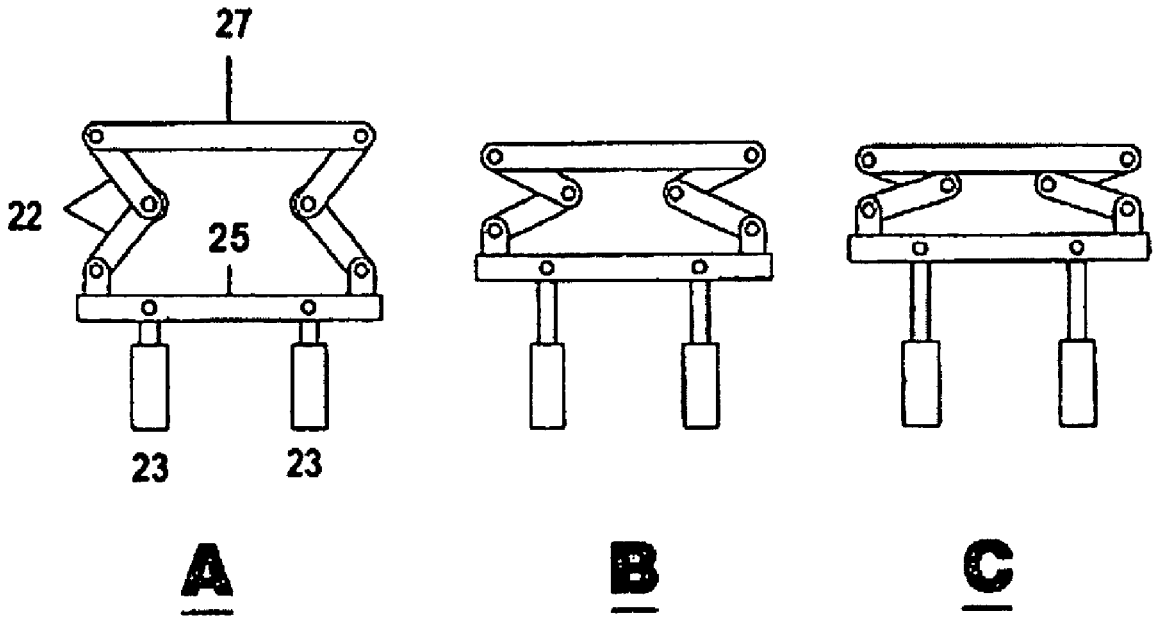
FIG. 3A illustrates an automatic work input centering and clamping mechanism in accordance with an exemplary embodiment of the present invention.
FIG. 3B illustrates the automatic work input centering and clamping mechanism of FIG. 3A in a moderately clamped position in accordance with an exemplary embodiment of the present invention.
FIG. 3C illustrates the automatic work input centering and clamping mechanism of FIG. 3A in a nearly fully clamped position in accordance with an exemplary embodiment of the present invention.

The automatic work piece centering and clamping mechanism 12 includes cylinders 20 which may be activated to cause articulated links 22 to move towards and engage the work input 14 while automatically centering the work input 14 to the bell (bonnet) 18. In operation, the chain driven hammer 10 may be lowered onto the work input 14 so that the work input 14 enters into the bell 18 of the hammer 10. The automatic work piece centering and clamping mechanism 12 is then engaged. Cylinders 20 may be powered by air, hydraulics, etc. and, when activated, cause the articulated links 22 to push towards the center. An alternative configuration for cylinders 23 is illustrated in FIGS. 3A-C. Additionally, FIGS. 3A-C illustrates the movement of the articulated links 22. Specifically, as the cylinders 23 are activated, a moveable connector 25 moves in relation to a fixed connector 27 so that the articulated links 22 move towards the center. As the articulated links 22 are pushed towards the center, clamping forces secure the work input 14 and the work input 14 is centered and held securely within the throw of the hammer 10. The force is applied by the articulated links 22 to help ensure adequate gripping of the work input 14 so accurate maneuvering and positioning of the work input 14 can take place. When the articulated links 22 have secured the work input 14, the hammer 10 and the work input 14 can be lifted together, positioned, and maneuvered quickly and easily with a high degree of placement accuracy for maximum production efficiency.

Once the work input 14 is correctly clamped, centered and is secure so as to comprise an effective hammer/work piece unit, it may be properly positioned in relation to a substrate such as the ground, beach etc. and hammering or driving can commence. Power may be applied from an electric motor, a hydraulic motor, an air motor, or any device that will impart a rotating force with torque to one or more of the sprockets 24 and 34 to rotate the sprockets. In an embodiment, torque is applied to a driven sprocket 24. The driven sprocket 24 rotates with torque causing a roller chain 26 positioned about the sprockets to move linearly and parallel with a ram guide tube 28 in a direction opposite to the pull of gravity. The roller chain 26 may have one or more lift/grab links 30 that mesh with a ram 32. The roller chain 26, with the ram 32 in tow, travels linearly between sprocket 34 and the tandem release sprocket assembly 36 to raise the ram 32 to a release point set by the location of the tandem release sprocket assembly 36.

Figure 2:
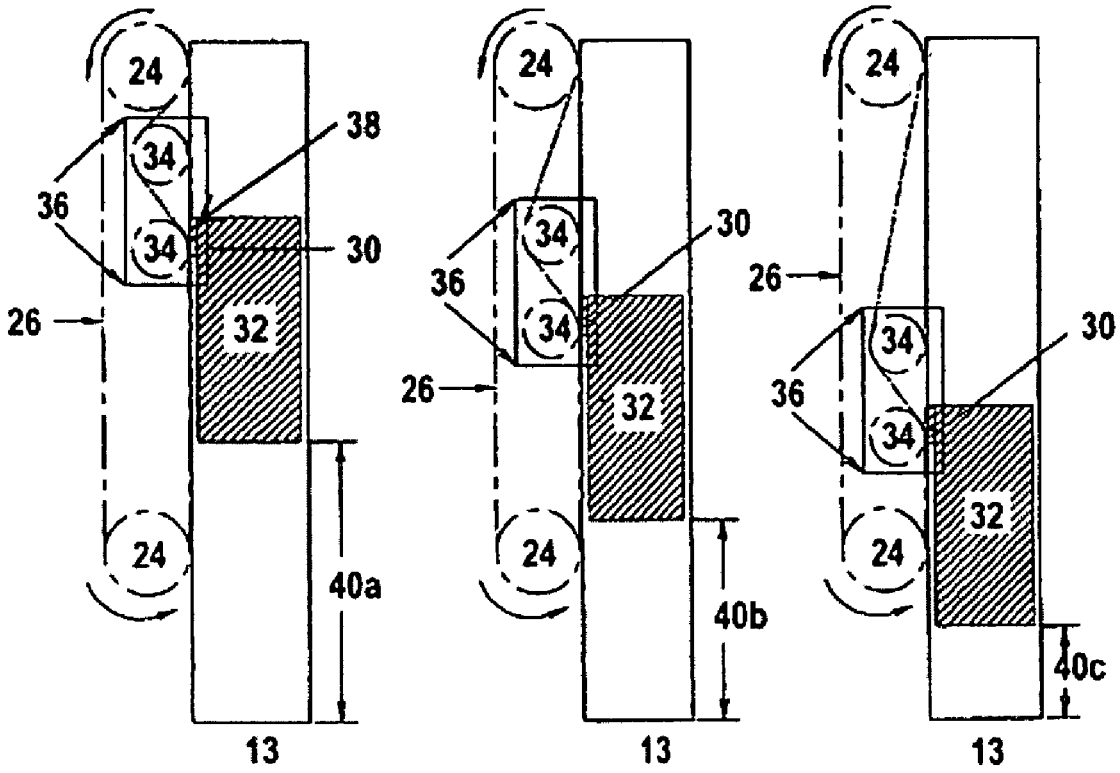
FIG. 2 illustrates a tandem sprocket ram release portion of a chain driven hammer in multiple positions in accordance with an exemplary embodiment of the present invention.

In an embodiment, the position of the tandem release sprocket assembly 36 can be adjusted up or down along the ram guide tube 28. As such, the ram free fall/drop length can be matched to the requirement of the specific hammer/driving job. FIG. 2 illustrates the adjustment of the position of the tandem release sprocket assembly 36 to adjust the free fall height of the ram 32. As discussed above, as the sprockets 24 and 34 rotate and impart torque to the roller chain 26 and the catch and lift link 30 meshes with the ram 32. The roller chain 26, with the ram 32 in tow, will follow a vertical path parallel with the ram guide tube 28 to a set release point 38 as determined by the position where the roller chain 26 rotates around the tandem release sprocket assembly 36. Upon reaching this release point 38, the chain link 30 will un-mesh with the ram 32 and the ram 32 will free fall (drop) and apply energy (impact force) to the work input 14, thus hammering (driving) the work input 14. The amount of energy (force imparted by the impact of the falling ram 32 with work input 14 per blow) is adjustable by the length of ram free fall as determined by the location of the tandem release sprocket assembly 36. As such, the positioning of the tandem release sprocket assembly shown on the right-hand side of FIG. 2 imparts less energy per blow than the position shown in the left-hand side of FIG. 2.

Additionally, the frequency of ram blows (strikes) applied to work input per minute can be adjusted by: increasing the rotational speed of the sprockets 24 and 34, adding multiple catch and lift chain links 30 to the roller chain 26, or increased sprocket 24 and 34 rotation speed with the addition of more catch and lift links 30 to the roller chain 26.

Figure 4:
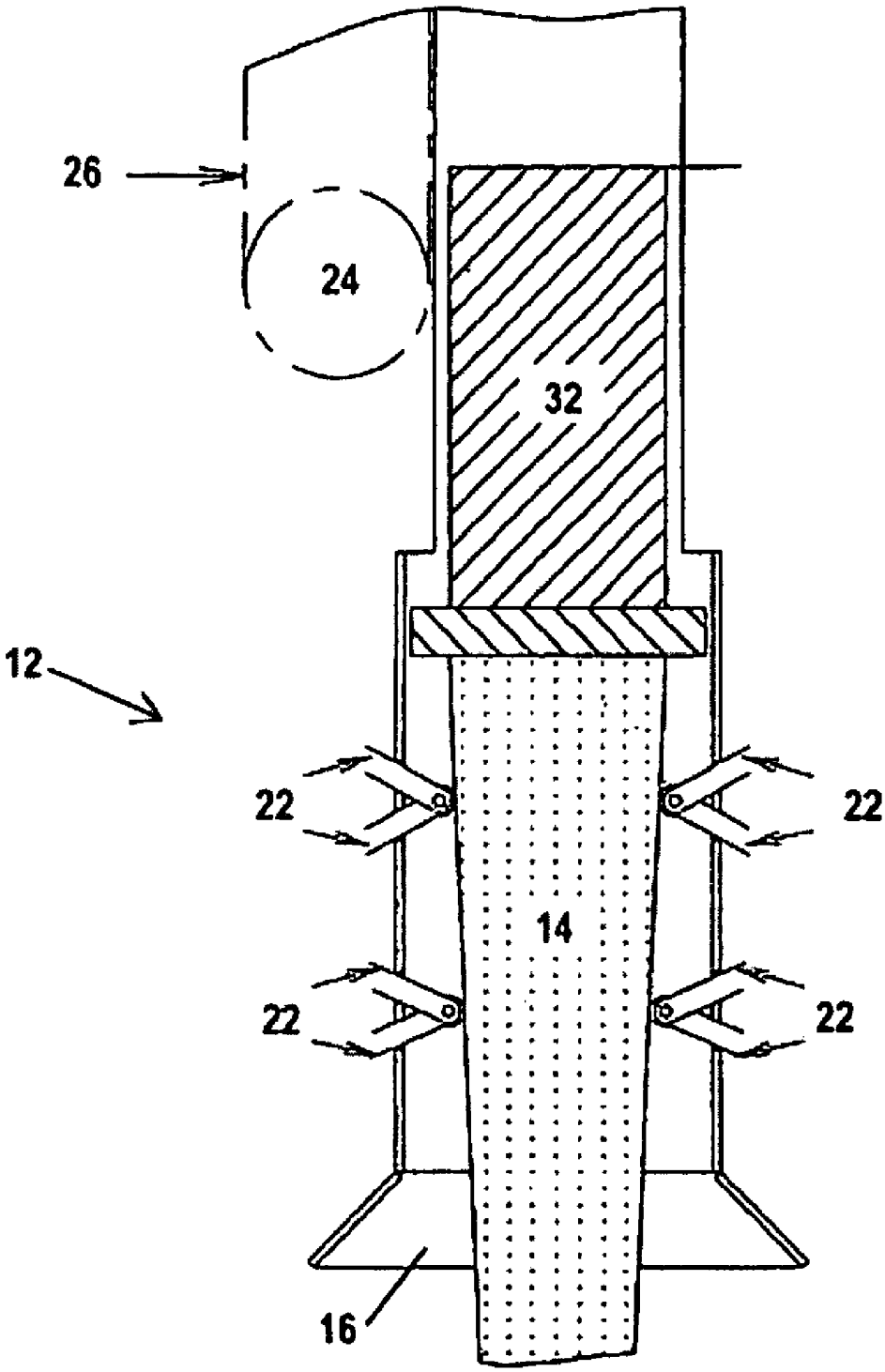
FIG. 4 illustrates the use of multiple automatic work input centering and clamping mechanisms to clamp a work input in accordance with an exemplary embodiment of the present invention.

Referring to FIG. 4, the automatic work piece centering and clamping mechanism 12 is shown clamping and centering the tapered pile 14. The number of articulated links 22 used by the centering and clamping mechanism 12 may be determined by the pile driving/hammer application. For example, three articulated links 22 may be used for a round pile, while a square pile may benefit from four articulated links 22. Also, to insure work input parallelism to a hammer and adequate clamping, more than one set of centering and clamping mechanisms 12 can be used on one hammer, as illustrated in FIG. 4. Specifically, multiple articulated link sets may be stacked. This multiple clamping/centering capability may be ideal for tapered piles, such as the tapered pile 14 shown in FIG. 4.

The previously described embodiments set forth a simple and rugged chain ram lifting system that can be easily adjusted for ram fall force per blow and frequency of ram fall (cycles per minute). The chain ram lifting system can be driven by an air motor, a hydraulic motor or any mechanism that imparts torque and rotation. Additionally, the automatic work piece centering and clamping mechanism 12 combines the hammer 10 and work input 14 into a single unit that can be maneuvered, positioned and hammered as a single unit with reduced hands-on manipulation by a worker, as longitudinal rigidity and alignment is provided by the clamped work input. Moreover, the work input 14 is centered to provide accurate parallel alignment with the hammer so that use of expensive lead systems can be reduced or illuminated in may applications. Further, with the effect of a hammer/work input unit, fewer guide cables are required. For example, one cable guides the hammer 10 with the work input 14 verses the old system of one cable guiding the hammer with additionally cables guiding the work input.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A reciprocating hammer system, comprising:

a hammer;

a bell coupled to the hammer, wherein the bell comprises a mechanism configured to substantially center and clamp a work piece within the bell, wherein the mechanism comprises a plurality of articulated links and a plurality of cylinders which, when activated, cause the articulated links to push toward the center of the bell;

a hammer guide configured to guide movement of the hammer; and a chain system for lifting the hammer to a drop point, the chain system comprising:

a plurality of sprockets; and a chain configured to move about the plurality of sprockets, wherein the chain comprises at least one mesh link configured to mesh with the hammer.

2. The reciprocating hammer system of claim 1, comprising:

a fixed connector coupled to the plurality of articulated links; and a moveable connector coupled to the plurality of articulated links, wherein the moveable connector is configured to move toward the fixed connector upon activation of the plurality of cylinders.

3. The reciprocating hammer system of claim 1, wherein the plurality of cylinders are pneumatically actuated.

4. The reciprocating hammer system of claim 1, wherein the plurality of cylinders are hydraulically actuated.

5. The reciprocating hammer system of claim 1, wherein at least one of the plurality of sprockets comprises a drive sprocket configured to be driven by a motor.

6. The reciprocating hammer system of claim 1, comprising a tandem release sprocket assembly mounted adjacent the hammer guide and configured to unmesh the hammer from the chain.

7. The reciprocating hammer system of claim 6, wherein the tandem release sprocket assembly comprises a tandem release sprocket configured to cause the chain to move away from the hammer guide.

8. The reciprocating hammer system of claim 6, wherein the tandem release sprocket assembly is adjustable up and down relative to the hammer guide.

* * * * *